US005472374A

United States Patent [19]

Yamada

[11] Patent Number: 5,472,374

[45] Date of Patent: Dec. 5, 1995

[54] POLISHING METHOD AND POLISHING DEVICE USING THE SAME

[75] Inventor: Atsushi Yamada, Hamura, Japan

[73] Assignee: Sumitomo Metal Mining Co., Ltd., Tokyo, Japan

[21] Appl. No.: 103,678

[22] Filed: Aug. 10, 1993

[30] Foreign Application Priority Data

Aug. 10, 1992 [JP] Japan ..... 4-234288

[51] Int. Cl.[6] ..... B24B 21/00

[52] U.S. Cl. ..... 451/303; 451/312

[58] Field of Search ..... 51/141, 149, 150, 51/154, 167.77, 165.9, 283 R, 284 R; 451/303, 312, 313, 317, 24, 341, 41, 42

[56] References Cited

U.S. PATENT DOCUMENTS 4,270,316 6/1981 Kramer et al. ..... 51/283 R
4,606,151 8/1986 Heynacher ..... 51/62
4,692,223 9/1987 Lampert et al. ..... 51/283 R
5,276,999 1/1994 Bando ..... 51/141

FOREIGN PATENT DOCUMENTS 3509004 9/1986 Germany ..... 51/141

*Primary Examiner*—Bruce M. Kisliuk
*Assistant Examiner*—Derris Banks
*Attorney, Agent, or Firm*—Watson, Cole, Grindle & Watson

[57] ABSTRACT

A polishing method and apparatus for a silicon substrate or the like, the method including disposing a polishing cloth in contact with a surface of a work to be polished, pressing the polishing cloth using pressing rods against the surface of the work to be polished in a region with a smaller area than the area of the surface of the work to be polished while adjusting the pressure of contact, and polishing the entire surface to be polished while moving the work relative to the polishing cloth and putting it under circulating movement with a radius smaller than a diametrical length of the region along the surface to be polished without autorotation.

16 Claims, 3 Drawing Sheets

POLISHING METHOD AND POLISHING DEVICE USING THE SAME

FIELD OF THE INVENTION

The present invention concerns a device for polishing, for example, a Silicon-On-Insulator substrate or Silicon substrate which is, mainly, a semiconductor substrate, to provide a uniform thickness.

BACKGROUND OF THE INVENTION

In recent years, techniques for polishing electronic parts such as semiconductor substrates to a higher accuracy have been necessary with the development of electronics industry itself.

As shown in FIG. 5, in a known method of polishing a semiconductor substrate or the like into a smooth, uniform thickness, a polyurethane pad attached to bottom end of a polishing rod 2 disposed above the work 1, which is covered by a colloidal silica solution, is moved into contact with the surface of the work 1, and the polishing rod 2 while autorotating about its central axis, successively horizontally displaced while reciprocating relatively on the work 1.

Polishing of the work 1 is achieved by previously measuring the thickness for each of the portions of the work 1 and controlling the autorotating speed of the polishing rod 2, the polishing pressure against the work, and the retaining time or the like corresponding to the required polishing amount for each of the portions. In this case, since the surface area of the work that can be polished by one polishing rod 2 is small, a plurality of polishing rods 2 are usually disposed in a desired arrangement density relative to the surface of the work 1 to be polished.

However, with the polishing device of the aforementioned type, since the polishing rod 2 is disposed vertically to the surface of the work 1 to be polished, the bottom end of the polishing rod 2 is formed as a flat surface in parallel with the polished surface and the polishing rod 2 autorotates with no rotation of the work 1, the relative speed of the polishing rod 2 to the work 1 is a maximum at the outer circumference and reduces to zero in the central portion at the bottom end of the polishing rod 2. Therefore, in the surface of the work 1 to be polished, only the portion at the peripheral edge of polishing rod 2 is well polished while the polishing amount is smaller at a portion near the central portion of the polishing rod 2, and such portion remains in a raised form. Generally, since the surface of the work 1 before polishing is in an uneven roughened surface, the above-mentioned trend is remarkable particularly upon polishing a convex portion, making it difficult to polish the entire surface of the work 1 to a uniform thickness.

Further, the polishing rod 2 is sometimes set to be inclined relative to the surface of the work 1 to be polished. In such a case, the polished surface is polished asymmetrically.

In order to eliminate the drawback of the polishing device wherein the polishing rod 2 autorotates solely, a planetary polishing device has been developed wherein a polishing rod 2 is caused to revolve along the surface to be polished under autorotation, which can overcome the problem that polishing is conducted extremely only at the outer edge of the polishing rod 2 as described above.

However, with the planetary type polishing device, since the mechanism for driving the polishing rod 2 is complicated in structure and is enlarged in size, a plurality of polishing rods cannot be disposed in a high density relative to the surface of the work 1 to be polished and a satisfactory polishing efficiency cannot be obtained. Further, the device can neither resolve the problem of the asymmetric polishing if the polishing rod 2 is inclined relative to the surface to be polished.

Furthermore, in the above-mentioned polishing rod autorotation type polishing device, the speed of the polishing fabrication is determined by the rotational linear velocity along the outermost edge at the bottom end of the polishing rod under autorotation. If the pressure of contact at the outermost edge is lowered, since the efficiency for the polishing fabrication is lowered, a sufficiently large load has to be applied to the polishing rod 2 as far as the outermost edge. However, when a high pressure is applied to the outermost edge of the polishing rod 2, since the surface of the work 1 to be polished undergoes a strong shearing Stress at the inside and the outside of the outermost edge of the polishing rod 2, there is a worry that a fatal defect will be created in the crystal surface of the work if it is, for example, a single crystal silicon substrate.

It is an object of the present invention to overcome the foregoing problems in the conventional method of polishing a semiconductor substrate or the like and to provide a novel polishing method capable of efficiently polishing a work at a more uniform thickness than usual while avoiding fatal defects in the crystal surface of the substrate after polishing. The object is also to provide a polishing device using such a method.

SUMMARY OF THE INVENTION

The polishing method according to the present invention for attaining the foregoing object comprises disposing a polishing cloth in contact with a surface of a work to be polished, pressing the polishing cloth with pressing rods against the surface of the work to be polished at a region of a smaller area than the area of the surface of the work to be polished while adjusting the pressure of contact, and conducting polishing while moving the work relative to the polishing cloth and putting it under circulating movement with a radius smaller than the diametrical length of the region along the surface to be polished without autorotation.

When the work is to be polished by the method according to the present invention, it is preferred that the bottom end of the pressing rod have a convex spherical shape in order to provide a pressure of contact against the polishing cloth for making the pressure distribution of the polishing cloth relative to the surface to be polished appropriate as will be described later. Further, it is preferred that an appropriate elastic member is disposed against the pressing rod on the side of the polishing cloth since this can provide a further advantageous effect of making the pressure distribution appropriate in cooperation with the sphericalization for the shape at the bottom end of the pressing rod.

DETAILED DESCRIPTION OF THE INVENTION

As has been described above, the polishing method according to the present invention comprises disposing a polishing cloth in contact with a surface of a work to be polished, pressing the polishing cloth with pressing rods against the surface of the work to be polished at a region of a smaller area than the area of the surface of the work to be polished while adjusting the pressure of contact, and conducting polishing while moving the work relative to the polishing cloth and putting it under circulating movement with a radius smaller than the diametrical length of the region along the surface to be polished without autorotation.

In the present invention, since polishing is conducted by urging the polishing cloth by a pressing rod against a surface of a work to be polished in a region of a smaller area than the area of the surface of the work to be polished while controlling the pressure of contact, and controlling the polishing amount by the pressing rod at a localized surface of the work, the fabrication accuracy is high in the localized surface. Further, since the work is moved while putting it under local circulating motion along the surface to be polished relative to the polishing cloth without autorotation and it is circulated evenly in all of the portions on the surface to be polished, the relative moving velocity of the surface to be polished relative to the polishing cloth is made uniform in each of the portions and the entire surface to be polished can be polished efficiently into a uniform thickness. Furthermore, since the radius of the circulating motion of the work is made smaller than the diametrical length of the region on the surface to be polished which is urged by a rod, the surface to be polished does not form a hollow annular shape but can be polished uniformly.

Figure 4:
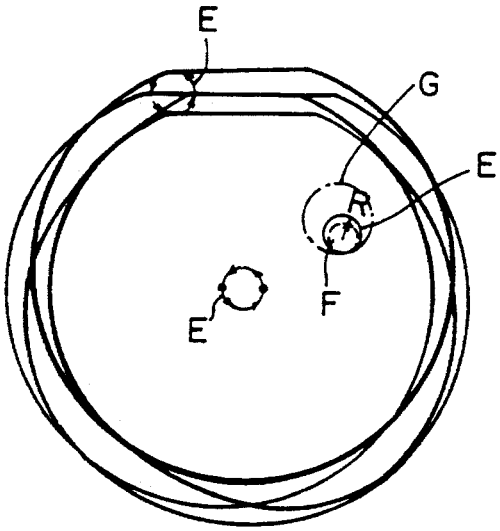
FIG. 4 is an explanatory view showing a relationship between the circulating movement of a work and a polishlng fabrication region by a pressing rod in the method according to the present invention.

The situation will now be explained referring to FIG. 4. That is, if the radius R of the circulating motion E is made smaller than the diametrical length of a region F on the surface to be polished which is urged by a rod, the periphery for the region G polished by the circulating motion is urged only intermittently by the polishing cloth, whereas the portion near the center of the region G is continuously urged by the polishing cloth and continuously undergoes polishing fabrication. Accordingly, the total fabrication time is maximum at the central portion and it is gradually shortened toward the peripheral edge. As a result, the region G to be applied with polishing does not form a hollow annular shape but, rather, repeating polishing fabrication is applied toward the inside and the abrasion amount is at the maximum in the central portion. On the contrary, if the radius R for the circulating motion increases greater than the diametrical length of the region F, the polishing fabrication range is formed as a hollow annular shape by the circulating motion, by which the convex portion at the central area can no more be flattened effectively.

In the present invention, the bottom end of the pressing rod is preferably made as a spherical convex surface. This is because the pressure of contact is highest at the crest of the bottom end of the pressing rod when the work is urged by way of the polishing cloth, by sphericalizing the bottom end of the pressing rod, the pressure of contact is gradually lowered and the polishing pressure is gradually lowered as it is apart from the crest, so that no shearing force is applied to the substrate as in the prior art and there is no more worry of causing defects in the crystal surface of the substrate. Further, sphericalization can also overcome the problem of the asymmetric polishing caused when the pressing rod is disposed being inclined relative to the work.

Furthermore, an elastic member is preferably disposed to the polishing cloth on the side of the pressing rod. This is because the bottom end of the pressing rod urges the polishing cloth by way of the elastic member, by which the polishing pressure of the pressing rod deforms the elastic member as far as the outer circumference of the contact region between the pressing rod and the elastic member, to urge the polishing cloth against the work such that the polishing pressure is moderately lowered from the bottom end to the outer circumference of the pressing rod, thereby capable of attaining uniform polishing application. In particular, when a raised portion in a work is to be polished, since the pressure of contact is large at the crest of the raised portion and the pressure of contact is gradually reduced toward the bottom of the raised portion, the distribution of the pressure of contact is made broader while lowering moderately from the central portion and, accordingly, the uniform polishing effect can further be enhanced to obtain a preferred result.

Theoretically, the entire area of the surface of the work to be polished can be polished with only one pressing rod by moving the surface to be polished under circulating motion in parallel with the surface to be polished of the work in one direction from one to the other end then moving it in perpendicular to the above-mentioned direction and then causing it to move in the direction opposite to the above-mentioned direction, with slight overlap in a zigzag manner, like that sweeping from one to the other side. However, since the actual area of the work is large as compared with the area of the pressing rod occupying the pressurizing surface, it is desirable to enhance the polishing efficiency by using a plurality of pressing rods simultaneously, for example, disposing a plurality rows of polishing rods, each row having a plurality of rods.

There is no particular restriction on the polishing cloth used in the method according to the present invention and a polyurethane non-woven fabric commercialized so far as for polishing, or a non-woven fabric further impregnated with a polyurethane resin and applied with hardening treatment may also be used. However, such a polishing cloth often has uneven hardness or fine unevenness on the surface, which may give an undesired effect on the surface of the work to be polished. Accordingly, upon conducting polishing by the method according to the present invention, it is preferred that a horizontal rotating motion is applied to the polishing cloth at a position of disposing the polishing cloth, separately from the circulating motion of the work, thereby always varying the position of the polishing cloth in contact with the work, thereby averaging the effect due to uneven hardness or uneven roughness of the polishing cloth.

Description will now be made more specifically with respect to a preferred embodiment of a polishing device suitable to practicing the polishing method according to the present invention. It will be apparent that the present invention is not restricted only to such embodiments.

Figure 1:
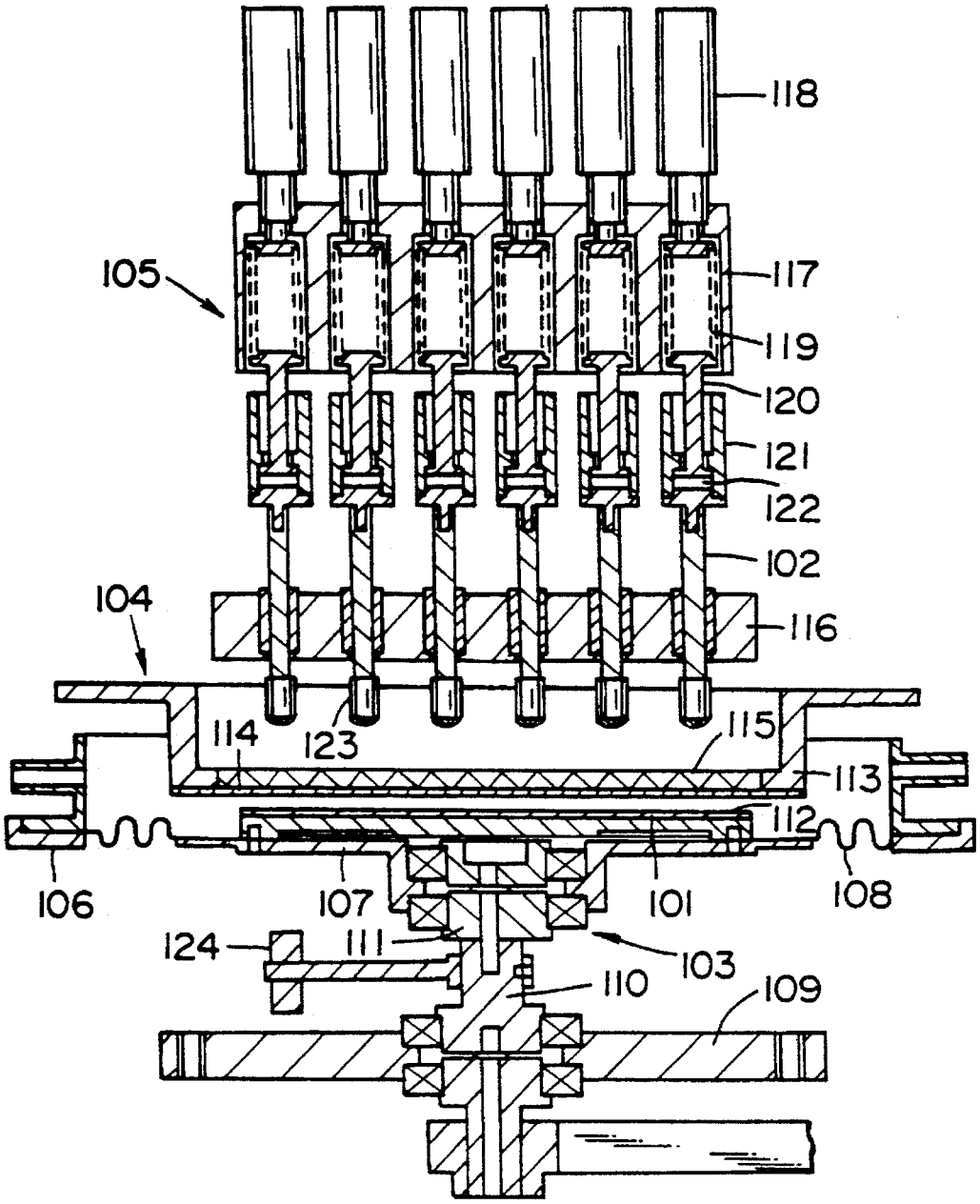
FIG. 1 is a side elevational view showing a preferred embodiment of a polishing device for practicing the present invention.

FIG. 1 shows a preferred embodiment of a polishing device for practicing the present invention. As shown in FIG. 1, the polishing device according to the present invention comprises a work support device 103, a polishing cloth support device 104 and a pressing rod support device 105. The work support device 103 has an annular fixing frame 106, a fabrication table 107 having a circumferential edge is secured to the inside of the fixing frame 106 by means of rubber bellows 108, a support frame 109 and a shaft 110 rotated by a motor (not illustrated) supported by the support frame 109. The fabrication table 107 is adapted to conduct circulating motion corresponding to an eccentricity amount of an eccentricity portion 111 formed at one end of the shaft 110 at an identical portion under restriction by the rubber bellows 108. For removing vibrations caused by the eccentric circulating motion, a weight 124 is attached to the shaft 110 on the side opposite to the eccentricity side of the eccentric portion 111 being situated to the outside of the shaft 110.

A work 101 such as a substrate is adapted to be fixed by adsorption on the fabrication table 107 in the fixing frame 106. The work support device 103 comprising the fixing frame 106 and the support frame 109 is adapted to conduct a zigzag movement of moving in a predetermined direction on a plane in parallel with the polished surface 112 of the work 101 and then slightly moving in the direction perpendicular to the predetermined direction. The feed device comprises a feed mechanism to two orthogonal directions by means of ball screws, for which a usual XY table capable of adjusting the feeding amount in each off the directions by the rotational amount of a motor that rotationally drives the ball screws may be used. Further, although not illustrated, a colloidal silica solution supply device is located near the fixing frame 106 for dipping the work 101, so that it passes from one to the other end of the work 101.

The polishing cloth support device 104 comprises a polishing cloth attaching frame 113 in the form of a cylindrical member opening at the central portion and having a flange formed at one end and a polishing cloth 114 secured at the circumferential edge to the other end of the cylindrical member of the polishing cloth attaching frame 113 and supported by a support device not illustrated such that the polishing cloth 114 can be in contact with the polished surface 112 or apart from the polished surface 112 in parallel with the polished surface 112 of the work 101 on the fabrication table 107. A plate-like elastic member 115 made of silicon rubber is secured by adhesion to the polishing cloth 114 on the side opposite to that of the work 101.

The pressing rod support device 105 comprises a support plate 116 in parallel with the polishing cloth 114, a plurality of pressing rods 102 held by the support plate 116 axially movably passing through the support plate 116 in perpendicular thereto, cylinder blocks 117 disposed above the support plate 116, linear actuators 118 disposed by the same number as the pressing rods 102, to the upper surface of the cylinder blocks 117, opposing to the pressing rods 102, springs 119 disposed in the cylinder blocks 117 for transmitting the polishing pressure of the linear actuators 118 on the side of the pressing rods 102, connection cylinders 121 connected to the upper ends of the respective pressing rods 102, pressure sensors 122 disposed in the connection cylinders 121 and intermediate shafts 120 for transmitting the resilient pressure of the springs 119 by way of the pressure sensors 122 to the pressing rods 102. Further, the bottom ends 123 of the pressing rods 102 protruding on the side of the elastic members 115 are made spherical.

Figure 2:
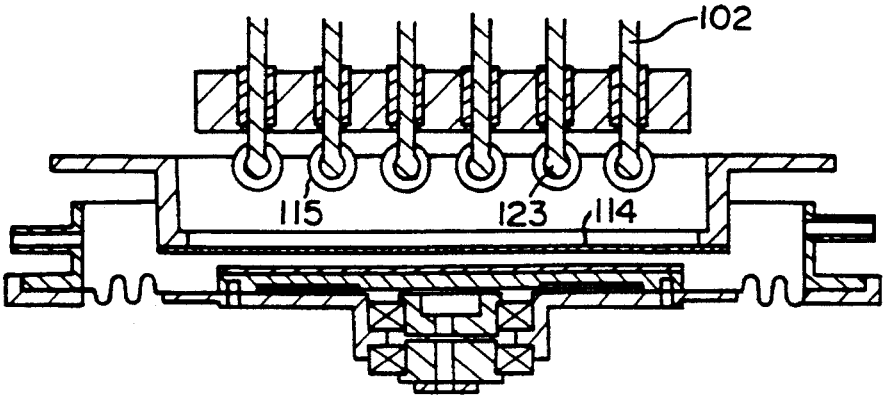
FIG. 2 is a fragmentary cross sectional view in a case where the spherical portion at the bottom end of the pressing rod is covered with an elastic member in the device shown in FIG. 1.

The elastic member 115 may be formed so as to cover the spherical bottom ends 123 of the pressing rods 102 instead of being disposed on the polishing cloth 114 as shown in FIG. 2.

The work 101 is polished by using the polishing device according to the present invention as shown in FIG. 1 by the following procedures. At first, a work 101 previously measured for the thickness of each of predetermined portions is attached to the fabrication table 107 and a colloidal silica solution is caused to flow in the fixing frame 106 so as to immerse the polished surface 112 of the work 101. Then, the polishing cloth attaching frame 113 is lowered such that the polishing cloth 114 can be in contact with the polished surface. Then, the linear actuators 118 are operated to descend the pressing rods 102, by which the bottom ends 123 are pressed against the elastic member 115 and the shafts 110 are rotated to start the movement of the work 101 in a predetermined direction while circulating the work at that position.

In this case, in order that polishing is conducted corresponding to a predetermined polishing amount determined by the previously measured thickness for the polishing region in the polished surface 112 urged by the pressing rods 102, the actuation amount of the actuators 118 are transmitted to the pressure sensors 122 and the response therefrom is fed back to the actuator 118 for control so that polishing can be applied appropriately in the polishing region.

Figure 5:
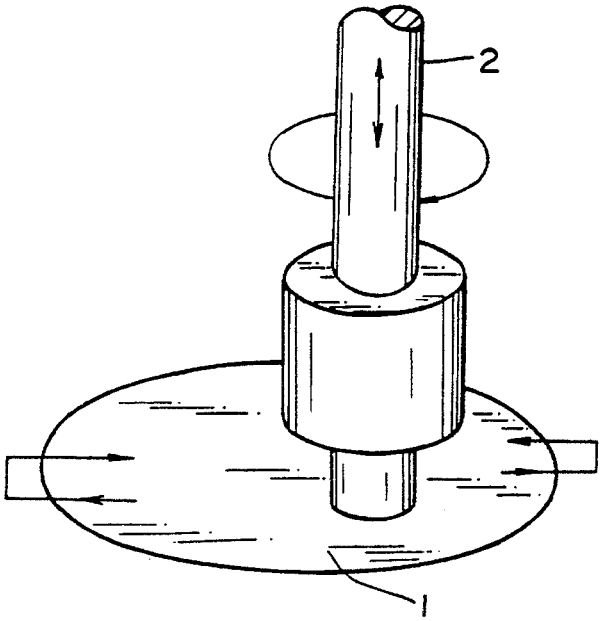
Fig. 5 PRIOR ART
FIG. 5 is an explanatory view for a conventional polishing device.

The work 101 is polished by the procedures as described above, the polishing operation will now be described more specifically with respect to concrete numerical values. In the polishing device shown in FIG. 1, when a silicon substrate used as a work 101 was polished while setting the diameter of the pressing rod 102 as 20 mm, the thickness of the plate-like elastic member 115 as 5 mm, the diameter of the spherical portion at the bottom end 123 of the pressing rod abutting against the elastic member 115 as 6 mm, the diameter of the polishing region in which the work is circulated at the polished surface of the work 101 as 10 mm, the circulating diameter of the work 101 as 4 mm, the rotational number of circulation as 1000 cycles/min and the overlapping width of the polishing regions caused by the reciprocal movement of the work 101 as 0.2 mm, the fluctuation range in the finished thickness was as small as +500Å and precise polishing capable of sufficiently coping with electronics materials could be applied. On the other hand, in a case where polishing was applied by using the polishing device by the conventional method as shown in FIG. 5, the fluctuation range of in the finished thickness was +3000Å, so that no precise polishing could be attained.

Figure 3:
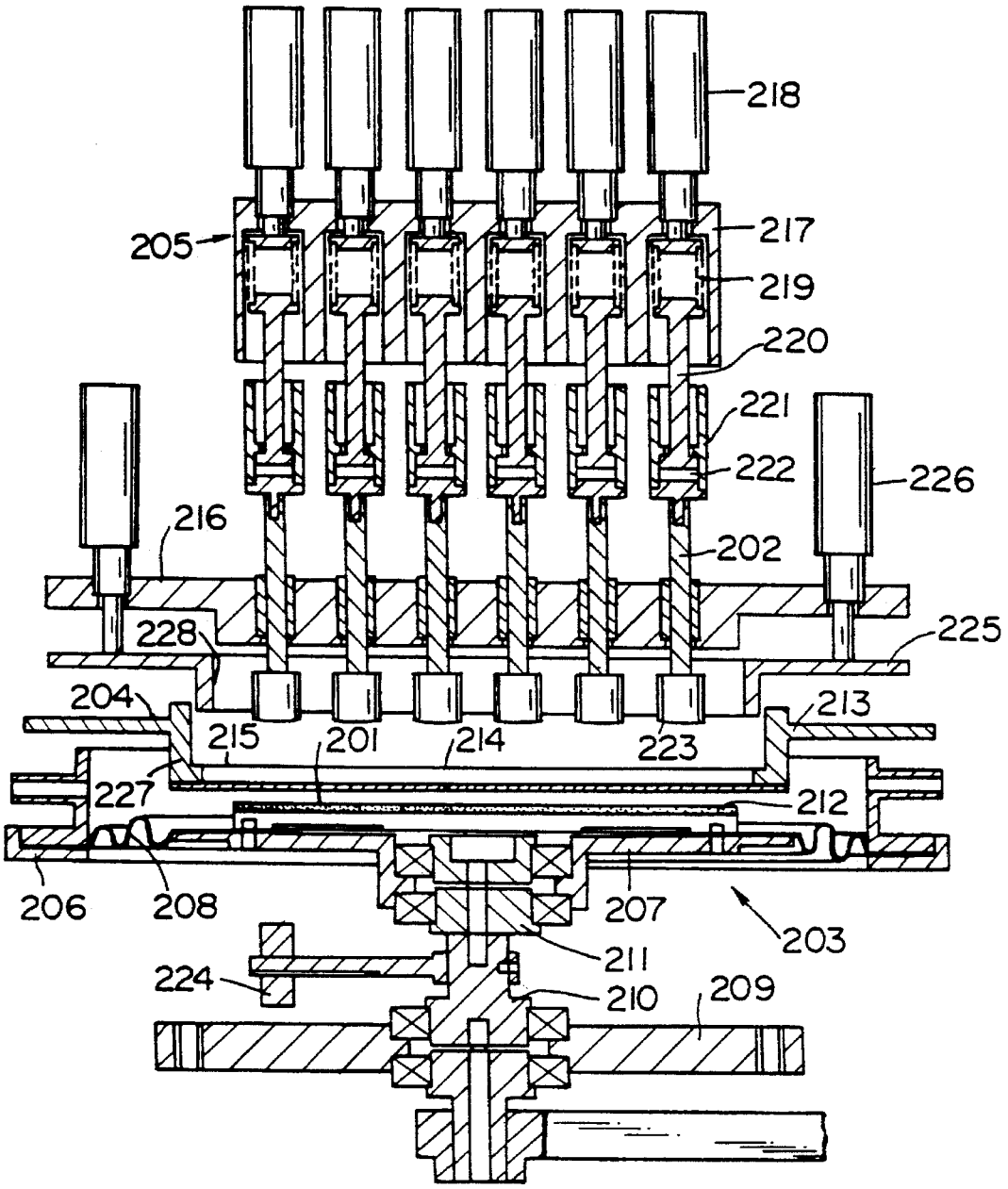
FIG. 3 is a side elevational view showing another preferred embodiment of a polishing device for practicing the present invention.

FIG. 3 shows another preferred embodiment of the polishing device for practicing the present invention. The polishing device shown in FIG. 3 comprises a work support device 203, a polishing cloth support device 204 and a pressing rod support device 205. The work support device 203 has an annular fixing frame 206, a fabrication table 207 joined at the peripheral edge to the inside of the fixing frame 206 by means of rubber bellows 207, a support frame 209 and a shaft 210 rotated by a not illustrated motor supported by the support frame 209. The fabrication table 207 is adapted to conduct a circulating motion corresponding to an eccentricity amount of an eccentric portion 211 formed at one end of the shaft 210 at an identical position while being restricted by the rubber bellows 208 by the eccentric portion 211. In order to remove vibrations caused by the eccentric circulating motion, a weight 224 is attached to a shaft 210 on the side of the eccentric portion 211 opposite to the eccentric side, being situated to the outside of the shaft 210.

A work 201 such as a substrate is fixed by adsorption on the fabrication table 207 in the fixing frame 206. The work support device 203 comprising the fixing frame 206 and the support frame 209 is adapted to conduct a zigzag motion of moving in a predetermined direction on a plane in parallel with the polished surface 212 of the work 201 and then moving slightly in the direction perpendicular to the above-mentioned predetermined direction by a feed device not illustrated. As the feed device, it is possible to utilize a usual XY table having a feeding mechanism in two orthogonal directions by means of ball screws and controlling the feed amount to each of the directions depending on the rotational amount of a motor that rotationally drives the ball screws. Further, although not illustrated, a colloidal silica solution supply device is disposed to the fixing frame 206 for immersing the work 201 and it is adapted to pass from one to the other end of the work 201.

The polishing cloth support device 204 comprises a polishing cloth attaching frame 213 in the shape of a cylindrical member opening at the central portion and having a flange formed at one end thereof and a polishing cloth 214 secured at the circumferential edge to the other end of the cylindrical portion 227 so as to close the other end of the cylindrical portion 227 of the polishing cloth attaching frame 213, and it is supported by a vertically moving support device not illustrated such that the polishing cloth 214 can be brought into contact with or apart from the polished surface 212 in parallel with the polished surface 212 of the work 201 on the fabrication table 207. A plate-like elastic member 215 made of silicone rubber is secured by means of adhesion to the polishing cloth 214 on the side opposite to the work 201.

The pressing rod support device 204 comprises a support plate 216 in parallel with the polishing cloth 214, a plurality of pressing rods 202 passing through the support plate 216 in perpendicular thereto and held movably in the axial direction by the support plate 218, cylinder blocks 217 disposed above the support plate 216, linear actuators 218 disposed, by the same number as the pressing rods 202, to the upper surface of the cylinder blocks 217 opposing to the pressing rods 202, springs 219 disposed in the cylinder blocks 217 for transmitting the polishing pressure of the linear actuators 218 on the side of the pressing rods 202, connection cylinders 221 connected at the upper ends of the respecive pressing rods 202, pressure sensors 222 disposed in the connection cylinders 221, and intermediate shafts 220 for transmitting the resilient pressure of the springs 219 by way of the pressure sensors 222 to the pressing rods 202. Further, the bottom ends of the pressing rods 202 protruding on the side of the elastic member 215 are made spherical.

Linear actuators 226 are attached to the support plate 216 such that a polishing cloth guide 225 disposed below the support plate 216 can be moved vertically by the linear actuators 226. A cylindrical portion 228 is formed in the central portion of the polishing cloth guide 225, such that the polishing cloth guide 225 is held in the upper position before and after the polishing fabrication by the actuation of the linear actuators 226 while the polishing cloth guide 225 descends during polishing in which the polishing cloth 214 is in contact with the work 201 by the actuation of the linear actuators 226, and the outer circumference of the cylindrical portion 228 fits to the inner circumference of a cylindrical portion 227 of the polishing cloth attaching frame 213 and is held, so that the polishing cloth attaching frame 213 can rotate at an identical position.

The work 201 is polished by using the polishing device according to the present invention shown in FIG. 3 by the following procedures. At first, the work 201 previously measured for the thickness in each of predetermined portions is attached to the fabrication table 207, and then the colloidal silica solution is caused to flow in the fixing frame 206 so as to immerse the polished surface 212 of the work 201. Then, the polishing cloth attaching frame 213 is caused to descend such that the polishing cloth 214 is brought into contact with the polished surface. Then, the linear actuators 226 are operated to descend the polishing cloth guide 225 and fit the cylindrical portion 228 to the inside of the cylinder portion 227 of the polishing cloth attaching frame 213. Then, linear actuators 218 are operated to descend the pressing rods 202 thereby press contact the bottom ends 223 to the elastic member 215, and the shaft 210 is rotated to start the movement of the polished surface 212 from one to the other end in the predetermined direction while circulating the work 201 at that position. In this instance, in order that polishing corresponding to a polishing amount predetermined depending on the previously measured thickness for the polishing region in the polished surface 212 pressed by the pressing rods 202 is conducted, the actuation amount of the actuators 218 is transmitted to the pressure sensors 222 and the response therefrom is fed back to the actuators 218 for control, so that polishing can be conducted appropriately in the polishing region.

The polishing is conducted over the entire surface of the polished surface by a plurality of pressing rods by causing the polished surface 212 having moved to the other end to move slightly in perpendicular to the previous moving direction, then moving it in the direction opposite to the previous direction and then moving successively laterally. In this instance, when a circulating motion is given to the work 201, it is observed that the polishing cloth 214 conducts extremely moderate autorotation at that position as compared with the circulating velocity in the circulating direction due to the friction between the work 201 and the polishing cloth 214.

In the device shown in FIG. 3, the work 201 is polished by the procedures described above. In the same manner as in the case of the device shown in FIG. 1, description will now be made more in details with reference to concrete numerical values. In the polishing device shown in FIG. 3, when a silicon substrate used as the work 201 is polished while using a polyurethane fiber non-woven fabric impregnated with a polyurethane resin as the polishing cloth 214 and setting the diameter of the pressing rod 202 as 20 mm, the radius of curvature at the lower surface as 25 mm, the thickness of the plate-like elastic member 215 as 5 mm, the diameter at the bottom end 223 of the pressing rod in contact with the elastic member 215 as 15 mm, the diameterical length of the polishing region in which the work is circulated in the polished surface of the work 201 as 19 mm, the circulating diameter of the work 201 as 4 mm, the rotational number of circulation 1000 cycles/min, the reciprocating range of the work 201 as 25 mm, the overlapping width of the polishing regions caused by the reciprocal movement as 0.2 mm, the fluctuation range of the finished thickness was only +500Å and the average surface roughness of the finished surface Ra was 20Å. On the other hand, when the same experiment was conducted by using this device while fixing the polishing cloth, although the fluctuation value in the finished thickness remained unchanged, the average surface roughness Ra was 100Å showing that better surface roughness can be obtained by rotating the polishing cloth.

As has been described above by the polishing method according to the present invention, since the work can be polished at a good accuracy and the polished portion of the resultant polished product has uniform thickness and extremely smooth polished surface, this can be said to be a polishing method suitable to polishing of a semiconductor substrate or the like for use in electronics industry.

I claim:

1. A polishing method which comprises disposing a polishing cloth in contact with a surface of a work to be polished, adjustably pressing the polishing cloth by a pressing rod against the surface of the work to be polished in a circular region defining a diametrical length and a smaller area than an area of the surface of the work to be polished, and polishing an entire surface to be polished by moving a polishing cloth and putting the work under circulating movement, the movement radius being smaller than said diametrical length pressed by each rod and without autorotation of the pressing rod.

2. A polishing method as defined in claim 1, wherein an end of the pressing rod which presses the polishing cloth has a spherical convex shape.

3. A polishing method as defined in claim 1, including a step of placing an elastic member between the polishing cloth and the pressing rod.

4. A polishing method as defined in claim 1, wherein a plurality of said pressing rods press the polishing cloth against the work surface.

5. A polishing method which comprises disposing a polishing cloth in contact with a surface of a work to be polished, adjustably pressing the polishing cloth by a pressing rod against the surface of the work to be polished in a region defining a diametrical length and a smaller area than an area of the surface of the work to be polished, and conducting polishing by moving a polishing region over the entire surface to be polished while moving the work relative to the polishing cloth and putting the work under circulating movement, the movement radius being smaller than said largest diametrical length pressed by each rod and without autorotation of the pressing rod, and revolving the polishing cloth along with the circulating motion of the work.

6. A polishing method as defined in claim 5, wherein an end of the pressing rod which presses the polishing cloth has a spherical convex shape.

7. A polishing method as defined in claim 5, including a step of placing an elastic material between the polishing cloth and the pressing rod.

8. A polishing method as defined in claim 5, wherein a plurality of said pressing rods press the polishing cloth against the work surface.

9. A polishing device comprising a work support device that supports a work and moves while conducting circulating motion along the surface of the work to be polished, a polishing cloth support device that supports the polishing cloth at the circumferential edge opposing to the surface of the work to be polished and in parallel with the surface to be polished and moves while causing the polishing cloth to be in contact with the work and a pressing rod support device that movably supports pressing rods disposed to the polishing cloth on the side opposite to the work toward the polishing cloth, in which each of the bottom ends of the pressing rods facing the polishing cloth is made spherical and an elastic member is disposed between the polishing cloth and the pressing rods.

10. A polishing device as defined in claim 9, wherein a plurality of pressing rods are disposed.

11. A polishing device as defined in claim 9, wherein the elastic member is a sheet of an elastic member which is disposed in contact with the polishing cloth on one side thereof and in contact with the bottom end of the pressing rods on an opposite side.

12. A polishing device as defined in claim 9, wherein the elastic member is disposed so as to cover the spherical surface at the bottom ends of the pressing rods.

13. A polishing device comprising a work support device that supports a work and moves while conducting circulating motion along the surface of the work to be polished, a polishing cloth support device that supports the polishing cloth at the circumferential edge opposing to the surface of the work to be polished and in parallel with the surface to be polished, causes the polishing cloth to move so as to be in contact with or apart from the work and rotatably holds the same and a pressing rod support device that movably supports pressing rods disposed to the polishing cloth on the side opposite to the work toward the polishing cloth, in which each of the bottom ends of the pressing rods facing the polishing cloth is made spherical and an elastic member is disposed between the polishing cloth and the pressing rods.

14. A polishing device as defined in claim 13, wherein a plurality of pressing rods are disposed.

15. A polishing device as defined in claim 13, wherein the elastic member is a sheet of an elastic member which is disposed in contact with the polishing cloth on one side thereof and in contact with the bottom end of the pressing rods on an opposite side.

16. A polishing device as defined in claim 13, wherein the elastic member is disposed so as to cover the spherical surface at the bottom ends of the pressing rods.

* * * * *